US008678183B2

(12) United States Patent
Jones

(10) Patent No.: US 8,678,183 B2
(45) Date of Patent: Mar. 25, 2014

(54) SYSTEM AND METHOD FOR DISPENSING ADDITIVES TO A CONTAINER

(75) Inventor: Travis Alan Jones, Austin, TX (US)

(73) Assignee: Lidquids, LLC, Austin, TX (US)

( * ) Notice: Subject to any disclaimer, the term of this patent is extended or adjusted under 35 U.S.C. 154(b) by 0 days.

(21) Appl. No.: 13/311,254

(22) Filed: Dec. 5, 2011

(65) Prior Publication Data

US 2012/0285844 A1 Nov. 15, 2012

Related U.S. Application Data

(63) Continuation-in-part of application No. 13/107,477, filed on May 13, 2011, now Pat. No. 8,479,914.

(51) Int. Cl.
*B65D 25/08* (2006.01)

(52) U.S. Cl.
USPC ..... 206/219

(58) Field of Classification Search
USPC ..... 206/219–222; 215/227.228; 366/130
See application file for complete search history.

(56) References Cited

U.S. PATENT DOCUMENTS 3,415,360 A * 12/1968 Baumann et al. ..... 206/222
3,425,598 A * 2/1969 Kobernick ..... 206/222
3,655,035 A * 4/1972 Muhlbauer ..... 206/219
3,762,540 A * 10/1973 Baumann et al. ..... 206/219
3,841,467 A * 10/1974 Hansen ..... 206/219
4,024,952 A 5/1977 Leitz
5,509,530 A * 4/1996 Wilson ..... 206/220
6,477,743 B1 11/2002 Gross et al.
6,609,612 B2 8/2003 Vlodek
6,854,595 B2 2/2005 Kiser
7,172,095 B2 2/2007 Marshall
7,337,921 B2 3/2008 Ma
7,568,576 B2 8/2009 Sweeney, Jr. et al.
7,588,142 B1 9/2009 Bush
7,748,550 B2 7/2010 Cho
7,823,723 B2 11/2010 Anthony et al.
2010/0258457 A1* 10/2010 Seelhofer ..... 206/222

* cited by examiner

*Primary Examiner* — Bryon Gehman

(74) *Attorney, Agent, or Firm* — Jackson Walker L.L.P.

(57) ABSTRACT

A method and system for liquid dispensing provides an additive to a base liquid in a container. The additive may be enclosed by an additive bladder that is contained in a container cap and supported by a retaining element having an additive dispensing hole. When the cap is screwed down, a convex element in the cap may press the additive bladder and dispense the additive. The cap may then be removed and may be configured to internally retain the retaining element and the emptied additive bladder. In certain instances, the additive bladder may be omitted from the method and system.

12 Claims, 16 Drawing Sheets

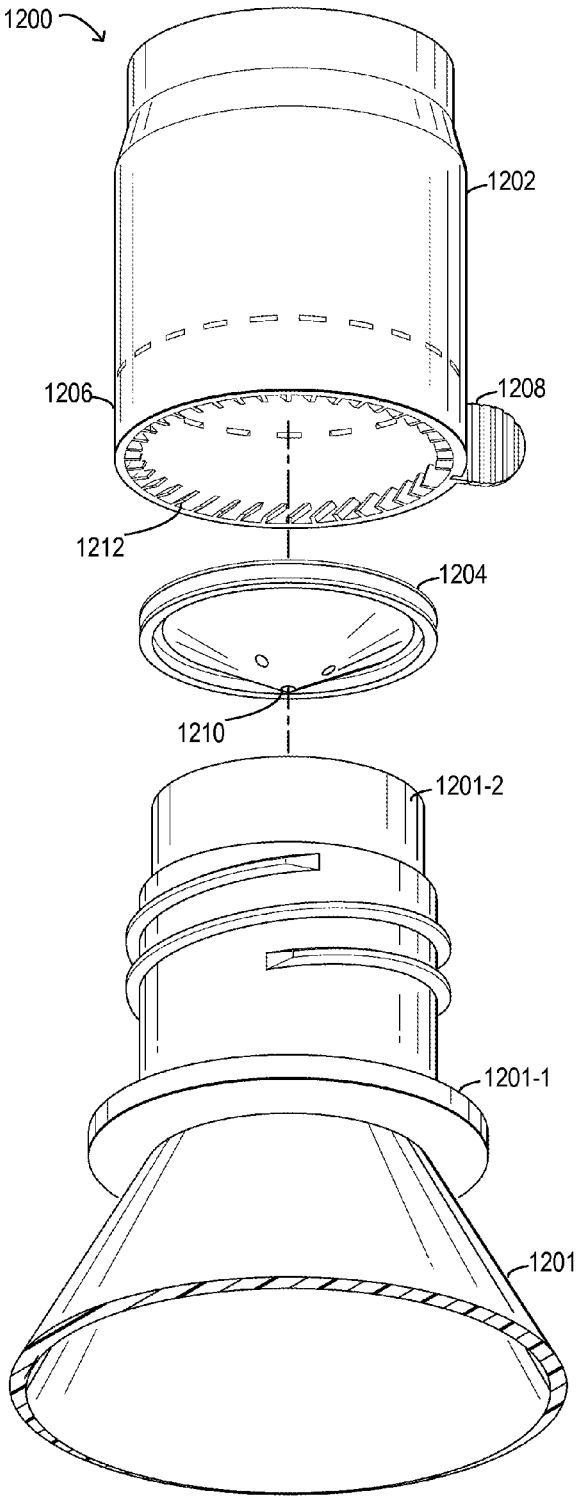
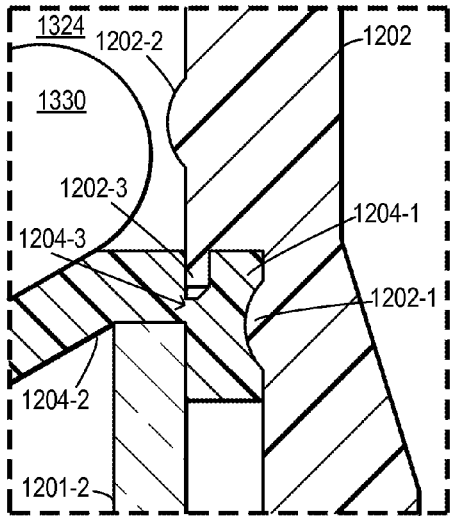
FIG. 14
FIG. 12

SYSTEM AND METHOD FOR DISPENSING ADDITIVES TO A CONTAINER

CROSS-REFERENCE TO RELATED APPLICATIONS

This application is a continuation-in-part of U.S. application Ser. No. 13/107,477 entitled "System and Method for Dispensing Additives to a Container" filed on May 13, 2011, now U.S. Pat. No. 8,479,914, and which is incorporated herein in its entirety by this reference.

BACKGROUND

1. Field of the Disclosure

The present disclosure relates to additive dispensing and, specifically, to dispensing of additives in a sealed container.

2. Description of the Related Art

Bottled containers are widely used to package and transport liquids, including beverages. In certain situations, it may be desirable to mix an additive to a base liquid. For example, a desired type of flavoring may be added to a base beverage, such as water. Various known methods for dispensing additives to liquid containers involve complex and customized mixing processes or bottle designs.

BRIEF DESCRIPTION OF THE DRAWINGS

FIG. 12 is an exploded perspective view of selected elements of an embodiment of a liquid dispensing system;

FIG. 14 is a cross-sectional view of selected elements of an embodiment of a liquid dispensing system.

DESCRIPTION OF THE EMBODIMENT(S)

Figure 1A:
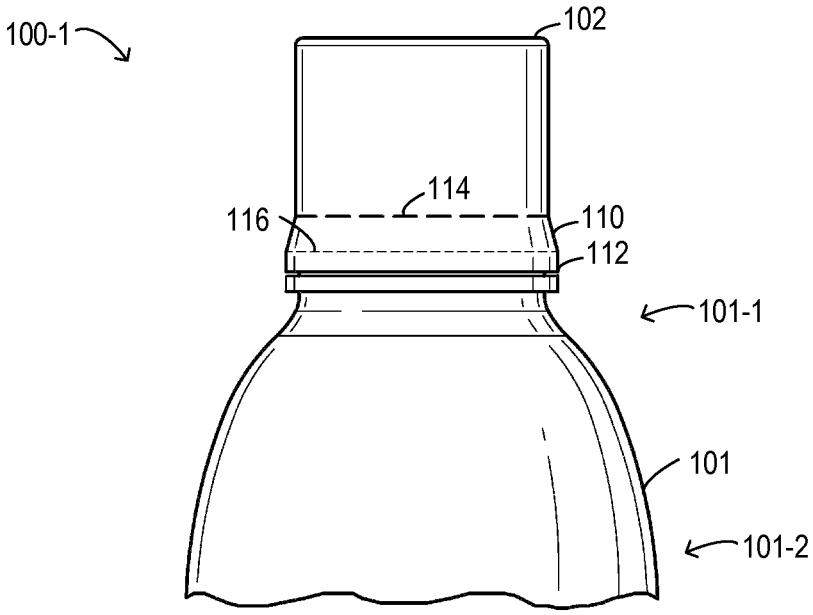
FIG. 1A is an external side view of selected elements of an embodiment of a liquid dispensing system.

In one aspect, a disclosed method for assembling an additive dispensing system includes filling a base liquid in a container having a threaded neck opening, placing a retaining element on the threaded neck opening, placing an additive bladder on the retaining element, the additive bladder including a portion of an additive enclosed by the additive bladder, and placing a removable cap for sealing the container over the retaining element and the additive bladder. The cap may include threads that rotatingly mate with the threaded neck opening, and a convex element configured to press the additive bladder against the retaining element.

In some embodiments, the method operation of placing the cap includes threading the cap against the threaded neck to form a cavity for accommodating the additive bladder between the retaining element and an interior surface of the cap. The cap may further include a sealing element for sealing the cavity. The interior surface of the cap may include the convex element. The retaining element may include an opening for dispensing the additive into the base liquid. In certain implementations, the additive dispensing system may be configured to enable dispensing of the additive into the base liquid by rotating the cap to press the convex element against the retaining element.

In another aspect, a contained system for dispensing additives includes a container for retaining a base liquid having a threaded neck opening, a retaining element in peripheral contact with the threaded neck opening and having an additive dispensing hole, and an additive bladder in contact with the retaining element, including a portion of an additive enclosed by the additive bladder. The system may also include a cap for sealing the container enclosing the retaining element and the additive bladder having threads that rotatingly mate with the threaded neck opening. The cap may include a sealing element for sealing a surface of the retaining element with respect to an interior surface of the cap and a convex element for pressing the additive bladder against the retaining element.

In some embodiments, upon rotation in a first angular direction, the cap may be configured to press the additive bladder against the retaining element in a closure direction, while the convex element presses against the bladder and the additive is released through the retaining element into the base liquid. Upon subsequent rotation in a second angular direction opposite the first angular direction, the cap may be configured to release the cap from the neck opening in an opening direction opposite the closure direction, while the retaining element and the empty bladder are retained in the cap.

In certain implementations, the system includes a spacer ring for securing the cap attached to an outer edge of the cap, while the spacer ring is configured to release upon rotation of the cap. A height of the spacer ring may correspond to at least a displacement of the cap sufficient to press substantially all of the additive from the additive bladder. The additive may be a liquid, a powder, a granulate, a paste, or a combination thereof. The additive bladder may be made of a material that substantially isolates the additive from the environment. The sealing element may be fixed to a circumferential edge of the retaining element.

In another aspect, a disclosed method for assembling an additive dispensing cap includes placing an additive in a cap for a container. The cap may include threads that rotatingly mate with a threaded neck opening of the container. The method may include placing a retaining element over the additive, wherein the retaining element is held in place between the threads and the additive. The method may further include providing a sealing element for sealing the retaining element with an interior surface of the cap. The cap may be configured to dispense the additive into the container through an opening in the retaining element when the cap is screwed on to the container.

In certain embodiments, the method may further include placing a convex element in the cap and providing the additive in an additive bladder. The cap may be configured to press the additive bladder between the retaining element and the convex element upon screwing on to the container.

In yet another aspect, a disclosed additive dispensing system includes a cap for sealing a liquid container having threads that rotatingly mate with a threaded neck opening of the liquid container. The system may include an additive bladder in contact with an inner surface of the cap and including a portion of an additive enclosed by the additive bladder, and a retaining element in contact with the additive bladder and having an additive dispensing hole. The retaining element may be held in place between the threads and the additive bladder. When the cap is screwed on to the liquid container, the cap may be configured to press the additive bladder between the retaining element and an interior surface of the cap, while the additive may be dispensed into the liquid container through the additive dispensing hole. The system may also include a convex element for pressing the additive bladder against the retaining element, while the interior surface of the cap is a surface of the convex element.

In still a further aspect, a method for assembling an additive dispensing system includes placing an additive bladder in a removable cap for sealing a container having a threaded neck opening and suitable for storing a base liquid, the additive bladder including a portion of an additive enclosed by the additive bladder. The method may further include installing a retaining element in the cap to form an additive cavity about the additive bladder. The retaining element and the removable cap may be configured to internally secure the retaining element and the additive bladder. The method may further include threading the cap against the threaded neck to seal the container, while the additive cavity may be sealed by at least two mating surfaces among the retaining element and the cap and the threaded neck opening.

In certain embodiments, the method may further enable dispensing of the additive into the base liquid by rotation of the cap to press the threaded neck opening against the retaining element. The retaining element may separate into a retaining disc that presses against the additive bladder and a retaining ring that remains internally secured within the cap.

In still yet another embodiment, a contained system for dispensing additives may include a container for retaining a base liquid having a threaded neck opening, a retaining element in peripheral contact with the threaded neck opening and having at least one additive dispensing hole, an additive bladder in contact with the retaining element, including a portion of an additive enclosed by the additive bladder, and a cap for sealing the container enclosing the retaining element and the additive bladder. The cap may further include threads that rotatingly mate with the threaded neck opening, a first circumferential cap fixture for mechanically securing the retaining element before dispensing of the additive, and a second circumferential cap fixture for mechanically securing at least a portion of the retaining element after dispensing of the additive.

In certain embodiments, the retaining element may separate into a retaining disc that presses against the additive bladder and a retaining ring that remains internally secured within the cap. The additive bladder may be of a material that substantially isolates the additive from the environment. An upper surface of the retaining element may include recessed radial channels in which the additive is directed to at least one additive dispensing hole.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, for example, widget 12-1 refers to an instance of a widget class, which may be referred to collectively as widgets 12 and any one of which may be referred to generically as a widget 12.

Bottled containers are widely used to package, transport, and dispense various types of liquids. A "bottled container", or simply, "container", as used herein refers to a sealed container having a neck opening configured to receive a closure element. A container will generally be configured to stand upright and will enable dispensing of a liquid content through the neck opening by tilting the container sideways. A container may be formed in various shapes, including, but not limited to, cylindrical, spherical, prismatic, or a number of different types of regular and/or irregular shapes. In many cases, the closure element is a threaded cap that may be initially sealed, but may be configured for reuse, for example, resealing the container after a desired amount of the liquid content is dispensed. The neck opening, thus, may be configured with external threads that mate with the threads of the threaded cap.

In the discussion herein, containers suitable for storing and dispensing liquid beverages are described as exemplary embodiments for clarity. It is noted, however, that the scope of the present disclosure is not limited to beverages, but rather, extends to various types of liquid content and corresponding containers, and may include, for example, non-beverages, chemicals, chemical precursors, biological agents, mixtures, solutions, colloids, paints, solvents, and other types of industrial liquids in different embodiments. In certain embodiments, the liquid content may be in a fluid or a fluid-like state, such as a super fluid, a fluidized substance (e.g., a powder and/or other type of particulate), a gaseous substance, an aerosol, and/or various combinations thereof.

Turning now to the drawings, FIG. 1A is an external side view of selected elements of novel liquid dispensing system 100-1. Liquid dispensing system 100-1, as shown, includes container 101, which is shown having neck portion 101-1 that narrows from main body portion 101-2 to form a neck opening (obscured from view in FIG. 1A). It is noted that a lower enclosed portion of main body portion 101-2 has been obscured from view for improved presentation. Covering the neck opening (obscured from view) is cap 102, which is shown in FIG. 1A in a sealed (i.e., closed) configuration. Cap 102 is removably attached to spacer ring 110, which, as will be described in detail below, enables cap 102 to be rotated in either direction from the configuration shown in FIG. 1A. Cap 102 is configured with a cavity that contains an additive for mixing with a base liquid (elements obscured from view in FIG. 1A) stored in main body portion 101-2. Also shown in FIG. 1A is locking ring 112, which may include a retention mechanism (obscured from view in FIG. 1A) that enables locking ring 112 and spacer ring 110 to be held in place when cap 102 is turned, thereby enabling release of spacer ring 110 and/or locking ring 112 from cap 102. In certain embodiments, spacer ring 110 may be configured with perforation 114 with respect to cap 102 that is weaker than perforation 116 with respect to locking ring 112, such that perforation 114 is preferentially torn upon rotation of cap 102.

Figure 1B:
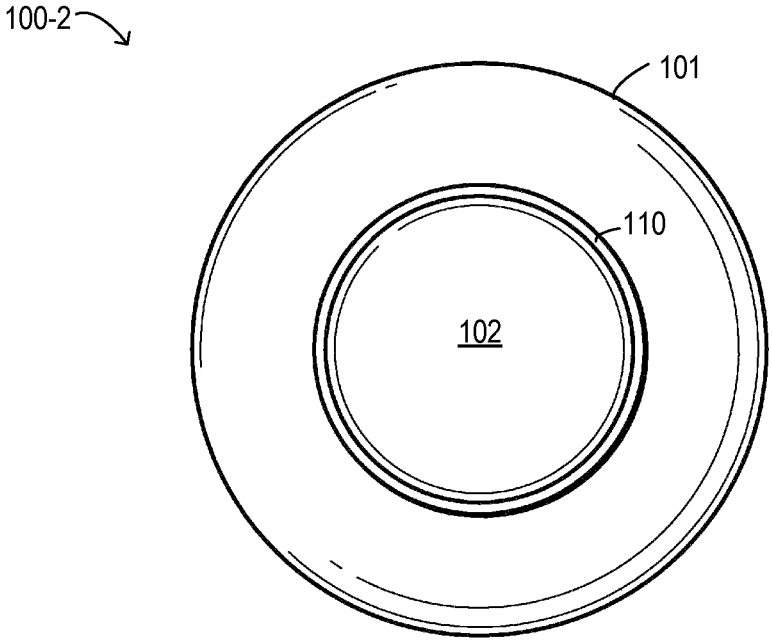
FIG. 1B is an external top view of selected elements of an embodiment of a liquid dispensing system.

In operation of liquid dispensing system 100-1, cap 102 may be rotated in a closure direction that directs cap 102 towards neck portion 101-1 and thereby releases spacer ring 110. At the same time cap 102 may cause the additive to be dispensed into the base liquid. In certain embodiments, the additive is included in an additive bladder that may be pressed, or squeezed by a convex element within cap 102, to release the additive. In other embodiments, the additive may be present in an additive chamber (obscured from view in FIG. 1A) within cap 102. Spacer ring 110 may correspond in height to a height of the additive chamber and/or the additive bladder, as will be described in further detail in the accompanying figures. It is noted that cap 102 may also be removed by rotating in an opening direction away from neck opening 101-1, either after dispensing of the additive, or without dispensing of the additive, to enable dispensing of liquid through the neck opening. FIG. 1B is an external top view of liquid dispensing system 100-2, in which container 101, spacer ring 110, and cap 102 are circularly formed. It is noted that container 101 may be formed in various shapes and geometries, as noted above, and yet still be configured with a circular neck opening for receiving cap 102.

Figure 2:
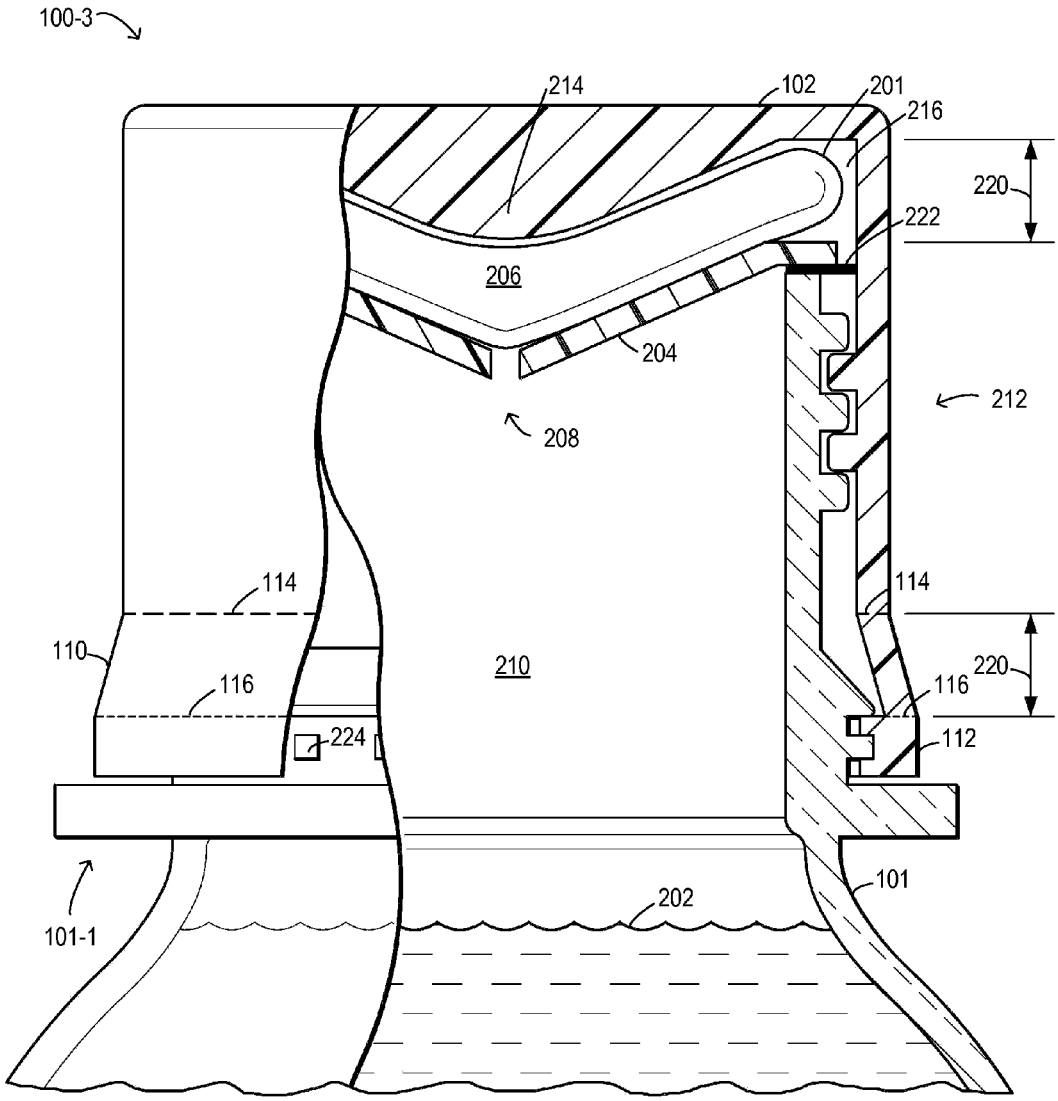
FIG. 2 is a cross-sectional view of selected elements of an embodiment of a liquid dispensing system.

Referring to FIG. 2, a cross-sectional view of selected elements of an embodiment of liquid dispensing system 100-3 is illustrated. It is noted that like numbered elements in FIG. 2 represent components discussed above with respect to FIGS. 1A-B. In liquid dispensing system 100-3, interior elements mentioned above with respect to FIG. 1A are now visible in partial cross-section. Container 101 is shown filled with base liquid 202, while void 210 represents a remainder of a volume content of container 101. It is noted that in various embodiments, void 210 may be filled with air or may be evacuated. When base liquid 202 includes a dissolved gas (e.g., carbon dioxide), void 210 may be pressurized to a vapor pressure of the dissolved gas when cap 102 seals container 101. Also visible in FIG. 2 is neck portion 101-1, which includes various structures for supporting cap 102, including threads in threaded portion 212 that mate with threads in cap 102. Spacer ring 110 is shown having vertical height 220, which is also the height of additive chamber 216 formed within cap 102. It is noted that vertical height 220 may vary, in different embodiments. Locking ring 112 is shown attached to spacer ring 110 via perforation 116, which, as mentioned above, may be stronger than perforation 114 attaching spacer ring 110 to cap 102. Also visible in FIG. 2 are detention elements 224, against which locking ring 112 may hold and provide a rotary detention when cap 102 is turned. It is noted that detention elements 224 and locking ring 112 may be configured to block rotation in a given direction, as desired.

Also shown in FIG. 2 is sealing element 222, which may provide a pressure seal to retain additive 206 within additive chamber 216, and prevent additive 206 from escaping through any other means except additive dispensing hole 208. In liquid dispensing system 100-3, sealing element 222 is depicted as a sealing ring that is placed between an upper lip of container 101 and retaining element 204, while also providing a seal with respect to an inside surface of cap 102. It is noted that other types of sealing elements and/or structures may be employed in different embodiments (see also FIGS. 3-4 and 7-8).

In FIG. 2, additive chamber 216 is shown as a cavity containing additive bladder 201, which encloses and seals additive 206. As noted previously, in certain embodiments, additive chamber 216 may contain additive 206 without additional structures. It is noted that additive bladder 201 may be made of various materials, including polymers, metals, and various types of composites, corresponding to desired physical properties. The thickness of additive bladder 201 may also vary, as desired, for a particular configuration of liquid dispensing system 100-3. Additive 206 may be any of a number of different types of materials, such as, but not limited to, a liquid, a powder, a granulate, a paste, or various combinations thereof. In one example embodiment, additive 206 may be a flavoring, a coloring, a thickener, or other dispensable ingredient, when base liquid 202 is a beverage, such as water.

As shown in FIG. 2, additive bladder 201 may be supported by retaining element 204, which may be a ring-shaped member supported by a top surface of neck portion 101-1 (i.e., the neck opening). Retaining element 204 may further be funnel-shaped and configured with additive dispensing hole 208. Convex element 214, which may form an interior surface of additive chamber 216, may be configured to press against additive bladder 201, and thereby cause additive 206 to be squeezed against retaining element 204 to the point of bursting. In this manner, additive 206 may be dispensed into base liquid 202 through additive dispensing hole 208, formed within retaining element 204 (see also FIG. 3). It is noted that the shape and/or profile of convex element 214 may vary according to additive bladder 201, additive 206, retaining element 204, and/or other factors, as desired for operation of liquid dispensing system 100-3. It is noted that in certain embodiments, convex element 214 may be a separate element that is introduced into cap 102 (see also FIGS. 5 and 6). In various embodiments, retaining element 204, convex element 214, and/or additive dispensing hole 208 may be circularly symmetrical.

Liquid dispensing system 100-3, as shown in FIG. 2, may provide for secure storage and separation of additive 206 and base liquid 202 in a state that is sealed from the environment. When blending of additive 206 with base liquid 202 is desired, cap 102 may be rotated in a closing direction (i.e., screwed down) to release spacer ring 110 and dispense additive 206. It is noted that the release of spacer ring 110 may enable cap 102 to be rotated in either direction and travel up or down with respect to neck portion 101-1. Cap 102 may then be removed by rotating in an opening direction to dispense liquid from container 101. Cap 102 may then be reused to seal container 101 after additive 206 has been dispensed and additive bladder 201 is substantially empty.

Figure 3:
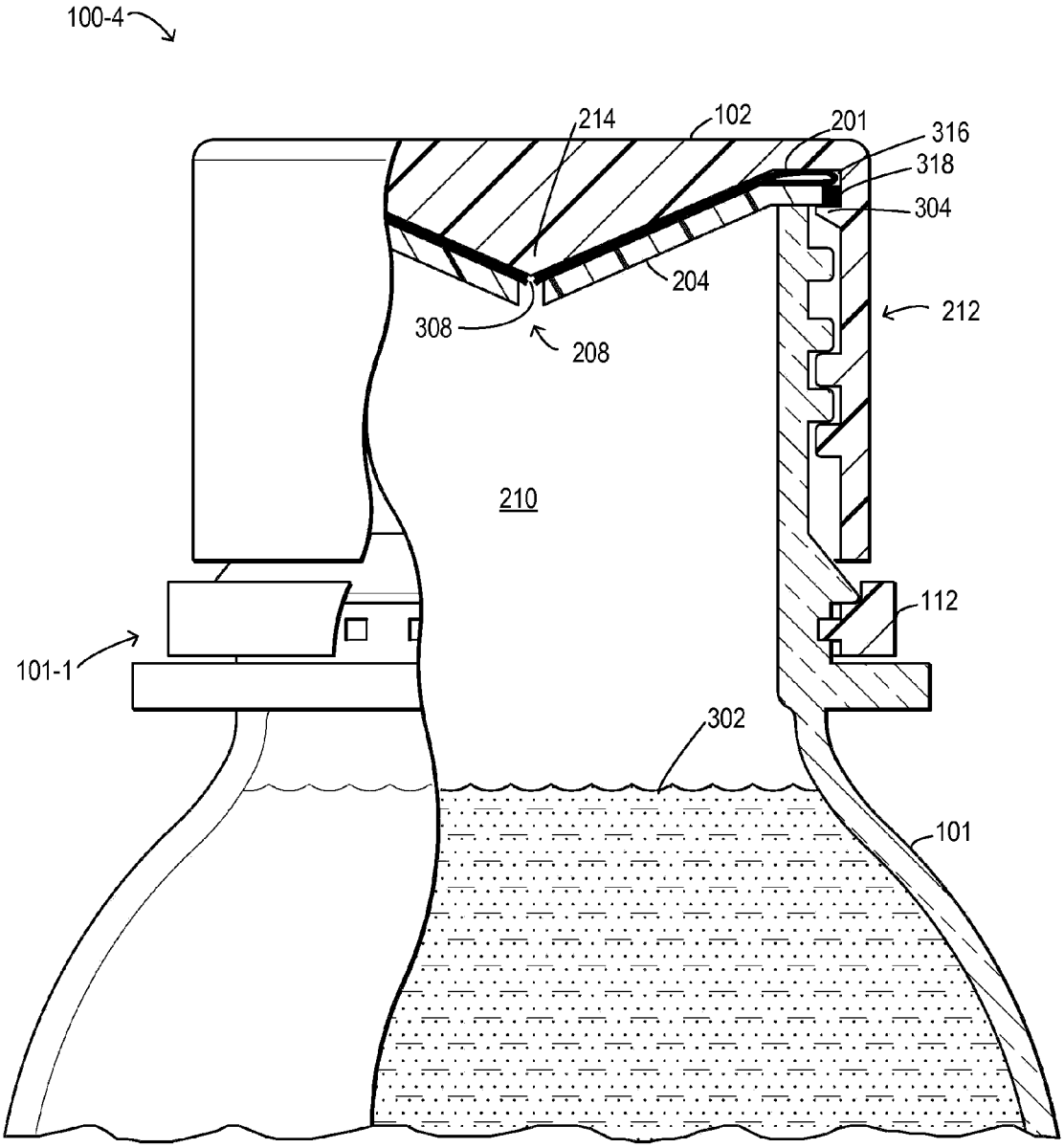
FIG. 3 is a cross-sectional view of selected elements of an embodiment of a liquid dispensing system.

Turning now to FIG. 3, a cross-sectional view of selected elements of an embodiment of liquid dispensing system 100-4 is illustrated. It is noted that like numbered elements in FIG. 3 represent components discussed above with respect to FIGS. 1A-B and 2, such as neck portion 101-1, threaded portion 212, and void 210. Liquid dispensing system 100-4 may represent a configuration of liquid dispensing system 100-3 after cap 102 has been screwed down and additive 206 has been dispensed into base liquid 202 (see FIG. 2). Accordingly, in FIG. 3, liquid 302 represents a blend of additive 206 and base liquid 202. Visible in FIG. 3 is locking ring 112, from which perforation 116 (see FIG. 2) has been separated. Absent in FIG. 3 is spacer ring 110, which may be removed after cap 102 is screwed down over vertical height 220 (see FIG. 2). It is noted that in liquid dispensing system 100-4 as shown, cap 102 may still seal container 101, even though spacer ring 110 has been separated from cap 102. In FIG. 3, additive chamber 316 has been reduced in size from vertical height 220 (see FIG. 2) after emptying additive bladder 201, which is now substantially devoid of additive 206. Convex element 214, shown in an exemplary configuration with angular surfaces, after impinging on additive bladder 201, has resulted in puncture 308 in additive bladder 201, through which additive 206 has been released through additive dispensing hole 208 in retaining element 204. Retaining element 204 may be fixed to cap 102 by means of retaining teeth 304, which may be formed within cap 102. Other methods of fixing retaining element 204 may also be realized in different embodiments. Also visible in FIG. 3 is sealing element 318, which is depicted as an exterior O-ring-type circumferential element affixed to an outer edge of retaining element 204. Thus, as in the embodiment shown in FIG. 3, sealing element 318 may provide a seal between retaining element 204 and an interior surface of cap 102, and may not be in contact with container 101. When cap 102 is removed, empty additive bladder 201 and retaining element 204 may thus be retained in cap 102.

Figure 4:
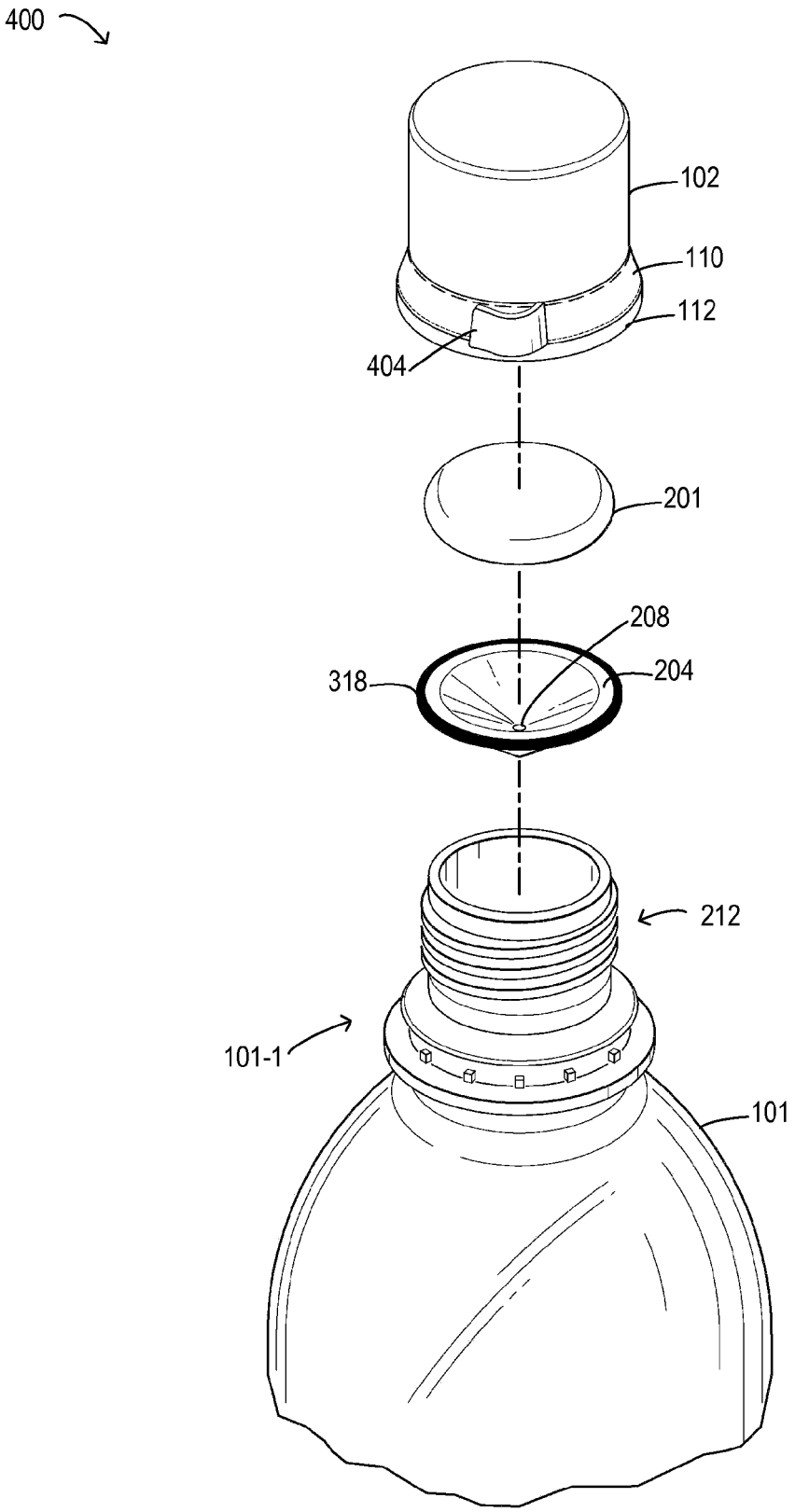
FIG. 4 is an exploded perspective view of selected elements of an embodiment of a liquid dispensing system.

Turning now to FIG. 4, an exploded perspective view of selected elements of an embodiment of liquid dispensing system 400 is illustrated. It is noted that like numbered elements in FIG. 4 represent components discussed above with respect to FIGS. 1A-B, 2, and 3. In FIG. 4, individual elements included in liquid dispensing system 400 are illustrated in suggestion of one embodiment of a method of assembly thereof. In some embodiments, novel liquid dispensing system 400 and a novel method of assembling liquid dispensing system 400 may be integrated into existing assembly methods and equipment (e.g., industrial bottling facilities) with relatively minor modifications. For example, after container 101 has been filled with base liquid 202 (not shown in FIG. 4, see FIG. 2), retaining element 204 may be placed on a top surface of neck portion 101-1 at the neck opening, such that additive dispensing hole 208 provides a passageway into container 101.

As shown in FIG. 4, retaining element 204 is equipped with sealing element 318. It is noted that in different embodiments, various types of sealing configurations may be implemented. For example, sealing element 222 (see FIG. 2) may be employed instead of, or in addition to, sealing element 318. Additive bladder 201 may then be placed upon retaining element 204. It is noted that additive bladder 201 may be manufactured and filled with additive 206 in a preliminary process (not shown), which may also provide significant economic and logistical advantages. Finally, cap 102, including spacer ring 110 and locking ring 112, may be secured to neck portion 101-1 at threaded portion 212. In the exemplary embodiment shown in FIG. 4, spacer ring 110 is shown including removal tab 404, which may provide for manual removal of spacer ring 110, as desired.

Figure 5:
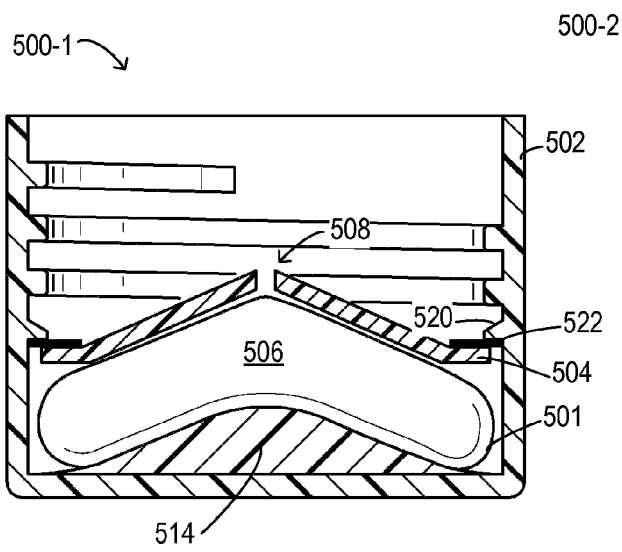
FIG. 5 is a cross-sectional view of selected elements of an embodiment of a liquid dispensing system.
Figure 6:
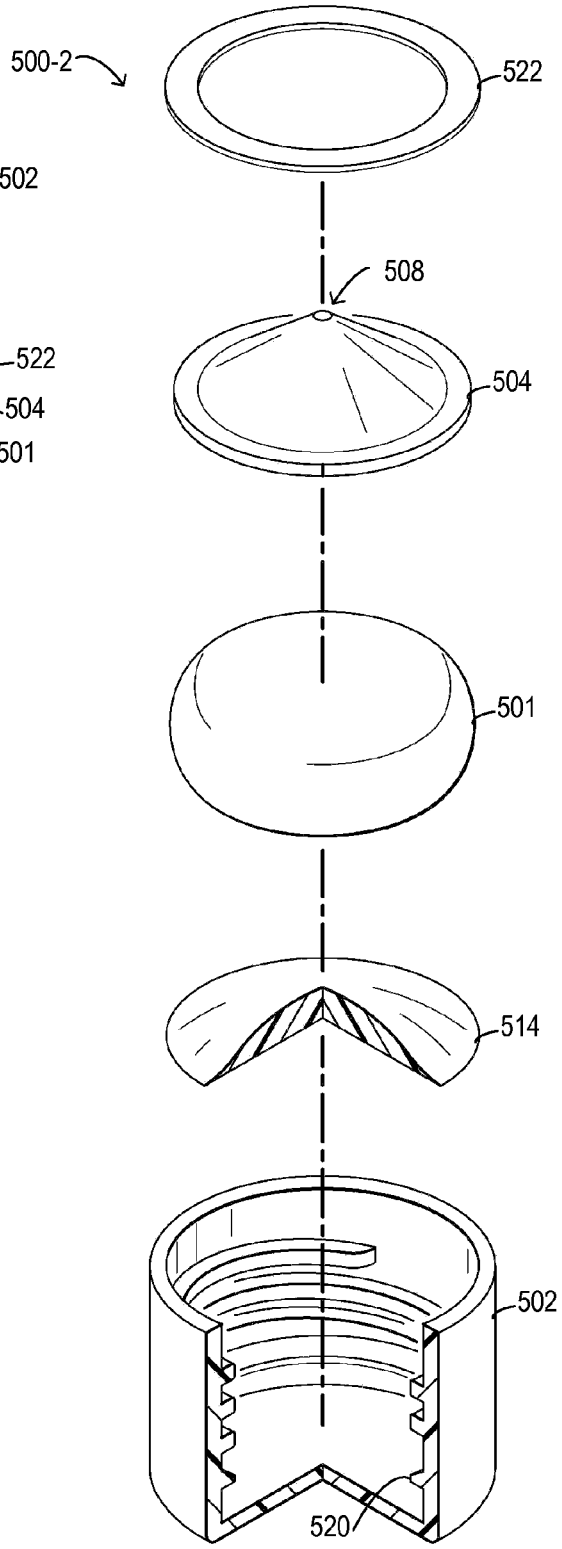
FIG. 6 is an exploded perspective view of selected elements of an embodiment of a liquid dispensing system.

Turning now to FIG. 5, a cross-sectional view of selected elements of an embodiment of liquid dispensing system 500-1 is illustrated. Liquid dispensing system 500, as illustrated in FIGS. 5 and 6, may represent an embodiment that is configured independently of container 101 (see FIGS. 1-4) and may be used with different instances of container 101. For example, liquid dispensing system 500 may be sold separately from container 101 to provide a variety of additive 506 selections for a consumer of container 101. Liquid dispensing system 500-1, as shown, includes cap 502, which may be substantially similar to cap 102, described above with respect to FIGS. 1-4. It is noted that cap 502 may include spacer ring 110 and/or locking ring 112 (not shown in FIG. 5) in certain embodiments. Cap 502 may contain additive bladder 501, which encloses a portion of additive 506. Additive bladder 501 may be substantially similar to additive bladder 201, as described previously herein. Cap 502 may further contain convex element 514, which is shown as a removable element in FIG. 5. Also included with liquid dispensing system 500-1 may be retaining element 504 having additive dispensing hole 508, which may be substantially similar to retaining element 204 and additive dispensing hole 208, described previously. As shown in FIG. 5, sealing element 522 provides a seal between retaining element 504 and an interior surface of cap 502, and optionally may seal an upper lip of container 101 (not shown in FIG. 5). Retaining element 504 and/or sealing element 522 may be held in place by retention tooth 520 formed within cap 502.

Turning now to FIG. 6, an exploded perspective view of selected elements of an embodiment of liquid dispensing system 500-2 is illustrated. It is noted that like numbered elements in FIG. 6 represent components discussed above with respect to FIG. 5. In FIG. 6, individual elements included in liquid dispensing system 500-2 are illustrated in suggestion of one embodiment of a method of assembly thereof. It is noted that the orientation of liquid dispensing system 500 depicted in FIGS. 5 and 6 is arbitrary and may be adapted in various embodiments. Cap 502 forming an interior cavity may be provided. Convex element 514 may be placed into the interior cavity and form a surface of the interior cavity. Additive bladder 501 may be placed in the interior cavity of cap 502. Retaining element 504, having additive dispensing hole 508, may be placed over additive bladder 501 and may be held in place between the threads of cap 502 and additive bladder 501. Sealing element 522 may then be placed above retaining element 504 and held in place by retention tooth 520. It is noted that another type of sealing element, such as an exterior O-ring-type circumferential element (see FIG. 3, sealing element 318), may be used in addition to or instead of sealing element 522 in different embodiments. Liquid dispensing system 500 may then be packaged and sold.

Figure 7:
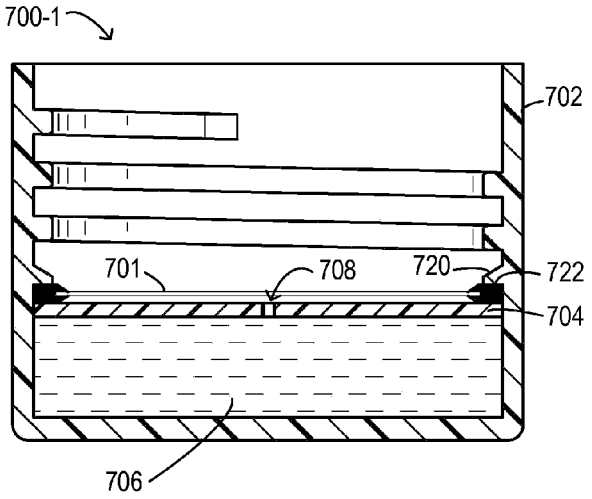
FIG. 7 is a cross-sectional view of selected elements of an embodiment of a liquid dispensing system.
Figure 8:
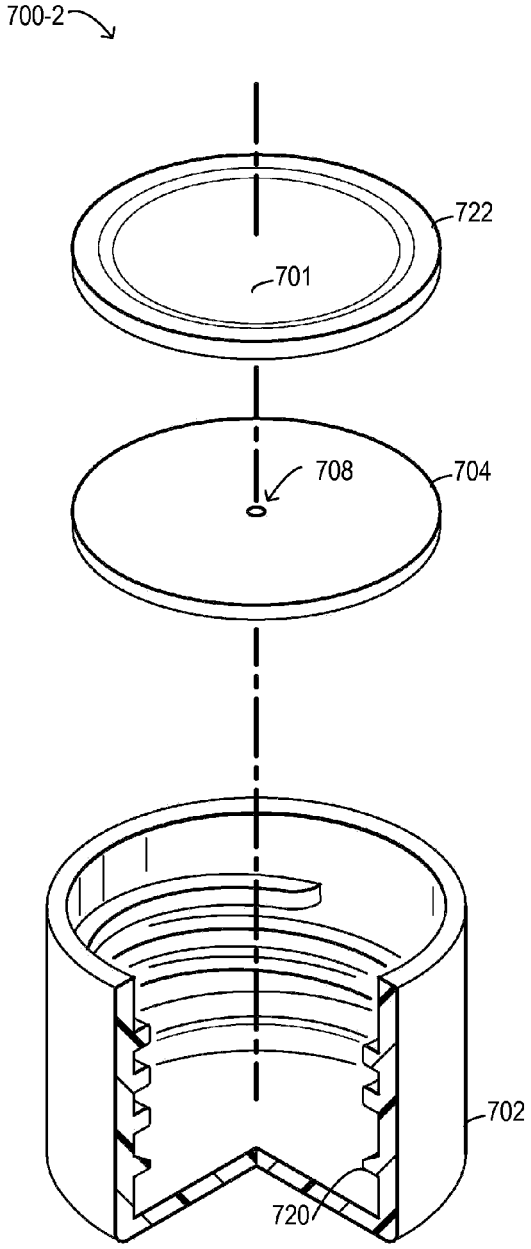
FIG. 8 is an exploded perspective view of selected elements of an embodiment of a liquid dispensing system.

Turning now to FIG. 7, a cross-sectional view of selected elements of an embodiment of liquid dispensing system 700-1 is illustrated. Liquid dispensing system 700, as shown in FIGS. 7 and 8, may represent an embodiment that is configured independently of container 101 (see FIGS. 1-4) and may be used with different instances of container 101. For example, liquid dispensing system 700 may be sold separately from container 101 to provide a variety of additive 706 selections for a consumer of container 101. Liquid dispensing system 700-1, as shown, includes cap 702, which may be substantially similar to cap 102, described above with respect to FIGS. 1-4. It is noted that cap 702 may include spacer ring 110 and/or locking ring 112 (not shown in FIG. 7) in certain embodiments. Cap 702 may be configured to receive a portion of additive 706. Also included with liquid dispensing system 700 may be retaining element 704 having additive dispensing hole 708. Additive dispensing hole 708 may also be used to fill additive 706 in cap 702, for example, by injection with a needle or similar structure (not shown in FIG. 7). As shown in FIG. 7, sealing element 722 provides a seal between retaining element 704 and an interior surface of cap 702, and optionally may seal an upper lip of container 101 (not shown in FIG. 7). Sealing element 722 may be formed as a circumferential element that includes bladder membrane 701, which may be a central portion that is thinner and configured to rupture under pressure. Retaining element 704 and/or sealing element 722 may be held in place by retention tooth 720 formed within cap 702.

Turning now to FIG. 8, an exploded perspective view of selected elements of an embodiment of liquid dispensing system 700-2 is illustrated. It is noted that like numbered elements in FIG. 8 represent components discussed above with respect to FIG. 7. In FIG. 8, individual elements included in liquid dispensing system 700-2 are illustrated in suggestion of one embodiment of a method of assembly thereof. It is noted that the orientation of liquid dispensing system 700 depicted in FIGS. 7 and 8 is arbitrary and may be adapted in various embodiments. Cap 702 forming an interior cavity may be provided. Retaining element 704, having additive dispensing hole 708, may be placed in cap 702. It is noted that additive 706 (not shown in FIG. 8, see FIG. 7) may be added prior to or after insertion of retaining element 704. Sealing element 722, having bladder membrane 701, may then be placed above retaining element 704 and held in place by retention tooth 720. Liquid dispensing system 700 may then be packaged and sold.

Figure 9:
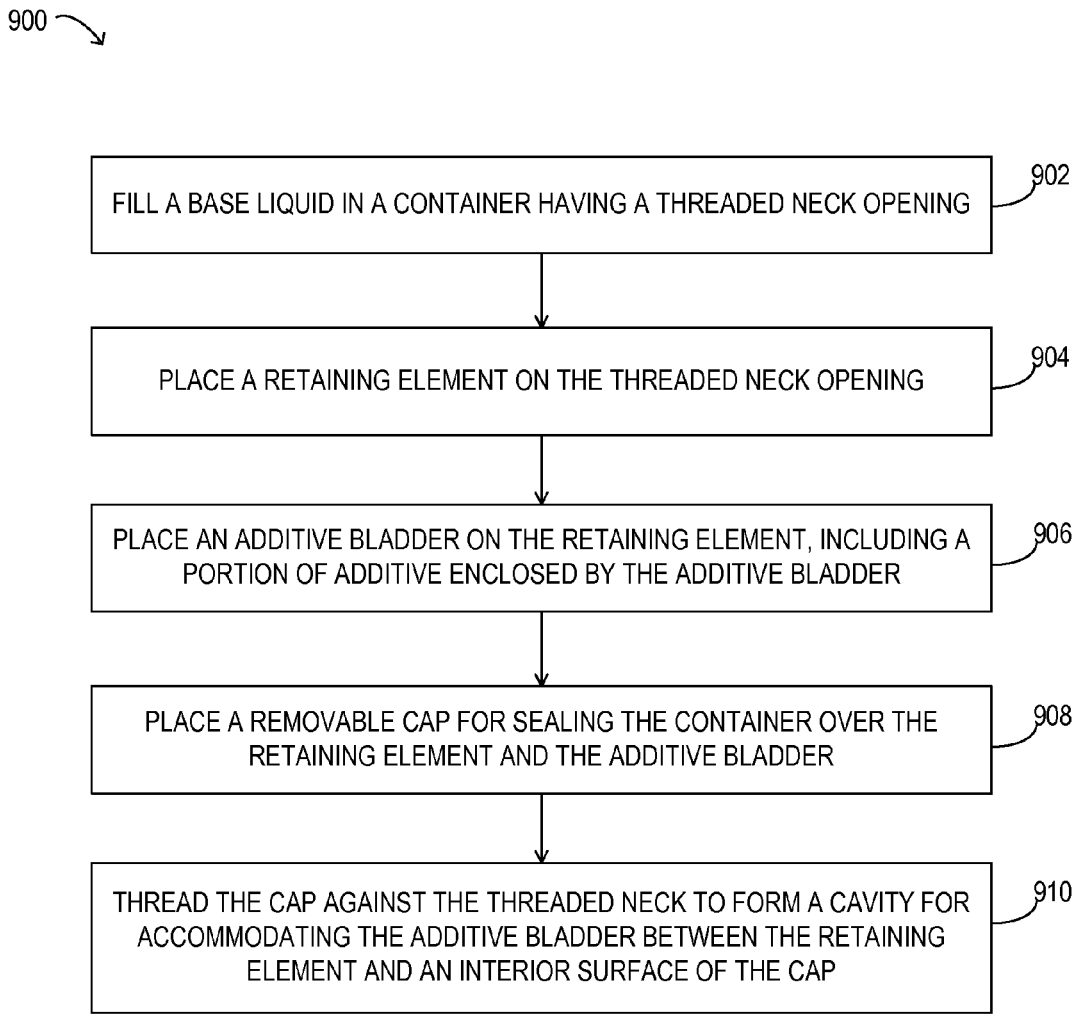
FIG. 9 is a block diagram of selected elements of an embodiment of a process for assembling a liquid dispensing system.

Turning now to FIG. 9, a block diagram of selected elements of an embodiment of method 900 for assembling a liquid dispensing system is depicted in flow-chart form. Method 900 may represent a method for assembling liquid dispensing system 100, in various embodiments. It is noted that certain operations described in method 900 may be optional or may be rearranged in different embodiments.

Method 900 may begin by filling (operation 902) a base liquid in a container having a threaded neck opening. The container may be a beverage container, such as a bottle. A retaining element may be placed (operation 904) on the threaded neck opening. The retaining element may include an additive dispensing hole for dispensing an additive into the base liquid. An additive bladder enclosing a portion of additive may be placed (operation 906) on the retaining element. A removable cap for sealing the container may be placed (operation 908) over the retaining element and the additive bladder. The cap may be configured with threads that rotatingly mate with the threaded neck opening. The cap may include a puncture element for puncturing the additive bladder. The cap may be threaded (operation 910) against the threaded neck to form a cavity for accommodating the additive bladder between the retaining element and an interior surface of the cap. The interior surface of the cap may include the additive bladder.

Figure 10:
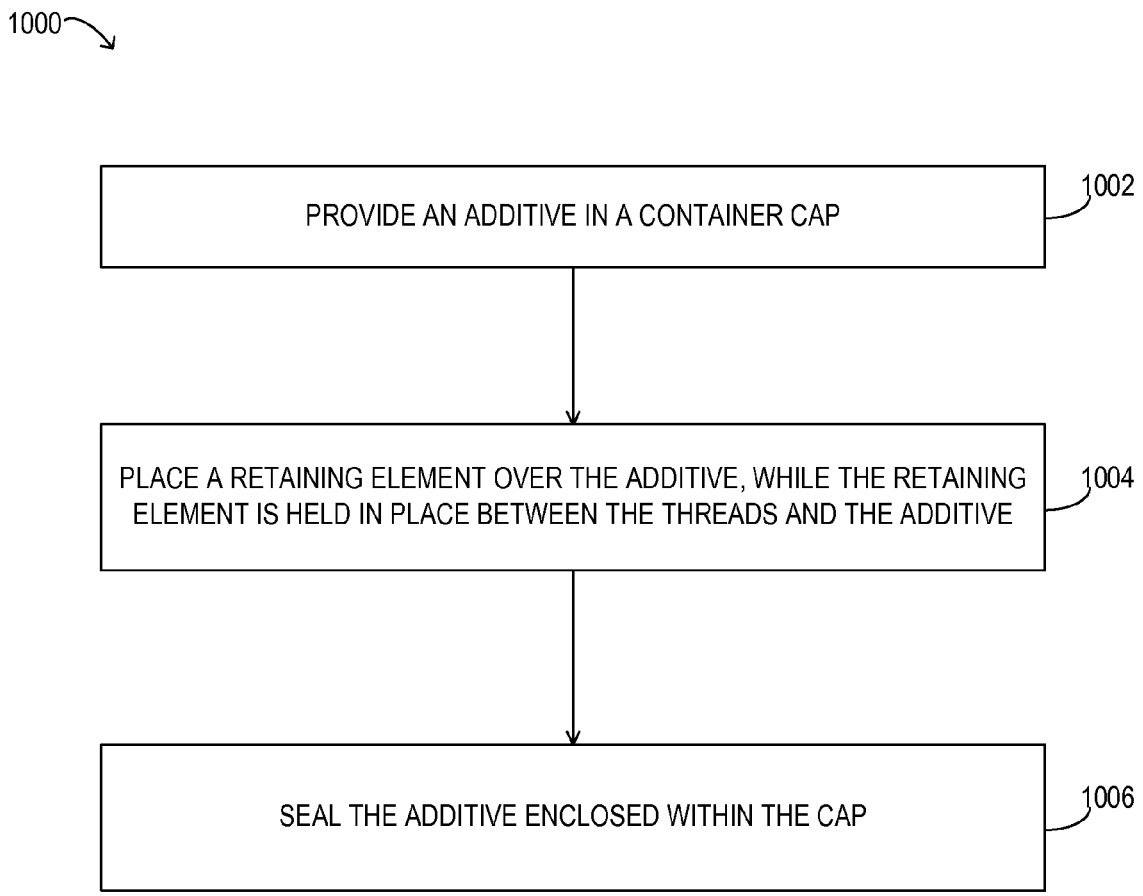
FIG. 10 is a block diagram of selected elements of an embodiment of a process for assembling a liquid dispensing system.

Turning now to FIG. 10, a block diagram of selected elements of an embodiment of method 1000 for assembling a liquid dispensing system is depicted in flow-chart form. Method 1000 may represent a method for assembling liquid dispensing system 500, in various embodiments. It is noted that certain operations described in method 1000 may be optional or may be rearranged in different embodiments. Method 1000 may begin by providing (operation 1002) an additive in a container cap. The additive may be provided enclosed in an additive bladder. A retaining element may be placed (operation 1004) over the additive, while the retaining element is held in place between the threads and the additive. The additive enclosed in the cap may then be sealed (operation 1006). The seal may be an internal sealing element in contact with an internal surface of the cap. In certain embodiments, an external seal, such as a shrink wrapping of the cap, may be used.

Figure 11:
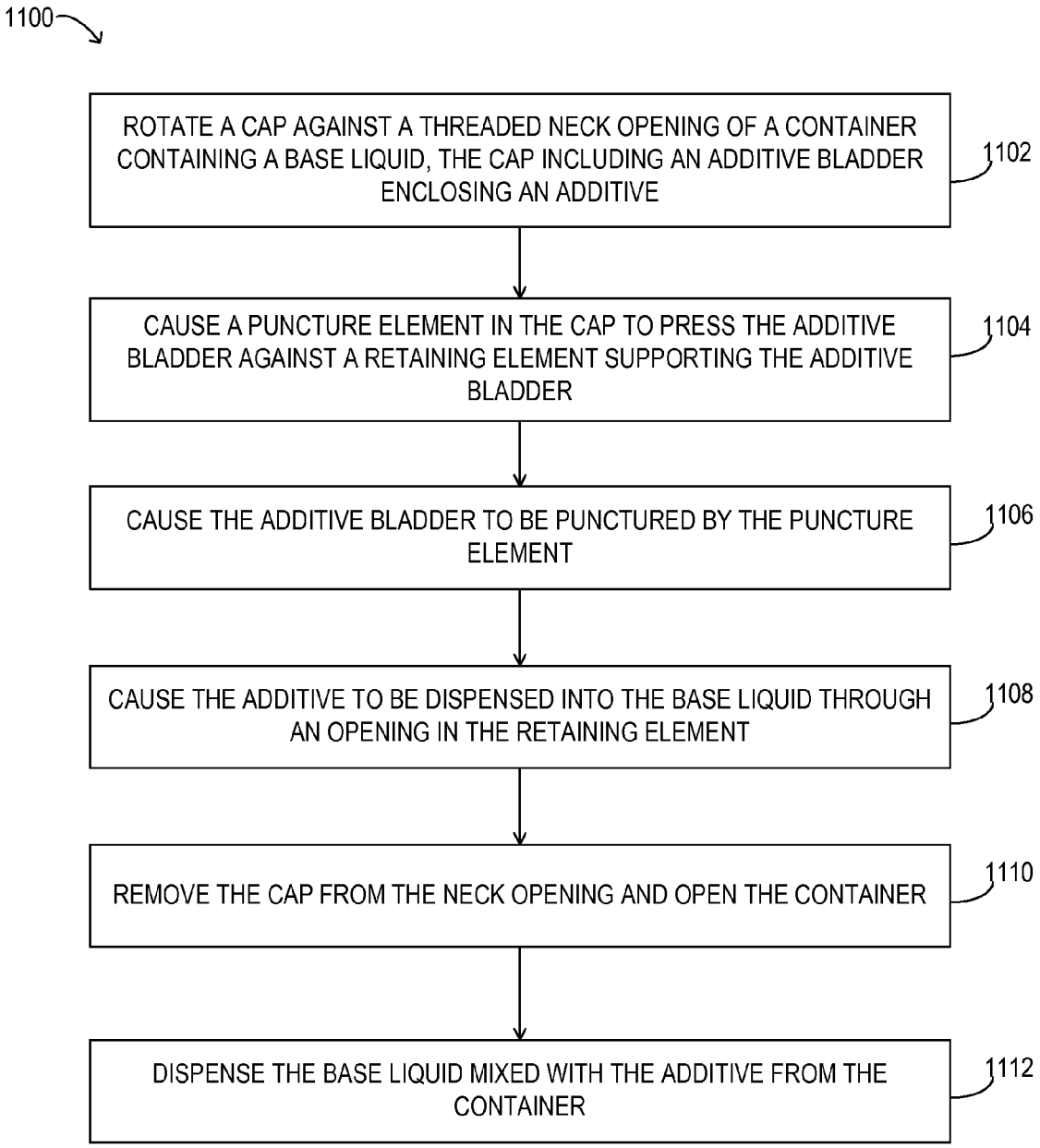
FIG. 11 is a block diagram of selected elements of an embodiment of a liquid dispensing process.

Turning now to FIG. 11, a block diagram of selected elements of an embodiment of method 1100 for operating a liquid dispensing system according to the methods described herein is depicted in flow-chart form. Method 1100 may represent a method for operating liquid dispensing system 100 and/or 500, in various embodiments.

Method 1100 may begin by rotating (operation 1102) a cap, which includes an additive bladder enclosing an additive, against a threaded neck of a container containing a base liquid. The cap may be rotated in a closing direction. As a result of operation 1102, a puncture element in the cap may be caused (operation 1104) to press the additive bladder against a retaining element supporting the additive bladder. Operation 1102 may then cause (operation 1106) the additive bladder to be punctured by the puncture element. Operation 1102 may then cause (operation 1108) the additive to be dispensed into the base liquid through an additive dispensing hole in the retaining element. The cap may then be removed (operation 1110) from the neck opening and the container may be opened. The empty bladder and the retaining element may be retained in the cap. The base liquid mixed with the additive may be dispensed (operation 1112) from the container.

Turning now to FIG. 12, an external exploded view of selected elements of novel liquid dispensing system 1200 is shown. Liquid dispensing system 1200, as shown, includes container 1201 for storing a base fluid (obscured from view in FIG. 12), which is shown having neck flange 1201-1 atop a neck portion that narrows from a main body portion to form neck opening 1201-2. Liquid dispensing system 1200 is further shown with retaining element 1204, which is configured to mate with an upper lip of neck opening 1201-2 and be enclosed by cap 1202. Retaining element 1204 may be configured with dispensing hole 1210 for dispensing an additive (obscured from view in FIG. 12) into an interior portion of container 1201 for mixing with the base fluid and may further exhibit a number of unique and novel features, as will be described in further detail below. Cap 1202 may be configured to cover neck opening 1201-2 and may further enclose an additive bladder (obscured from view). Cap 1202 may also exhibit various additional unique and novel elements, as will be described in detail below. Also shown in FIG. 12 is spacer/locking ring 1206, which may include a retention mechanism, such as detention elements 1212, that enable spacer/locking ring 1206 to be held in place when cap 1202 is turned, thereby enabling release of spacer/locking ring 1206 from cap 1202. In certain embodiments, spacer/locking ring 1206 may be configured with a perforation with respect to cap 1202, as will be further explained below. In FIG. 12, spacer/locking ring 1206 is shown including removal tab 1208, which may provide for manual removal of spacer/locking ring 1206, as desired. It is noted that in different embodiments, removal tab 1208 may be optional.

As described previously, cap 1202 may be rotated in a closure direction that directs cap 1202 towards neck flange 1201-1 and thereby releases spacer/locking ring 1206. At the same time cap 1202 may cause the additive to be dispensed into the base fluid. In certain embodiments, the additive is included in an additive bladder (obscured from view in FIG. 12) that may be pressed, or squeezed by a convex element within cap 1202, to release the additive. In other embodiments, the additive may be present in an additive chamber (obscured from view in FIG. 12) within cap 1202. Spacer/locking ring 1206 may correspond in height to at least a height of the additive chamber and/or the additive bladder, as will be described in further detail. It is noted that cap 1202 may also be removed by rotating in an opening direction away from neck flange 1201-1, either after dispensing of the additive, or without dispensing of the additive, to enable dispensing of liquid through the neck opening.

As noted previously, cap 1202 may be manufactured and/or sold separately from container 1201. In one embodiment, cap 1202 may be formed and then assembled for use with liquid dispensing system 1200. For example, an additive bladder (not shown in FIG. 12) including a portion of an additive enclosed by the additive bladder may be placed in cap 1202. Retaining element 1204 may then be secured in cap 1202 (see FIGS. 13A-13E, 14) forming an additive cavity that encloses and supports the additive bladder. As will be described below, cap 1202 may accordingly be formed with various internal structural features (not shown in FIG. 12, see FIGS. 13A-13E, 14) for securing retaining element 1204 and the additive bladder prior to, during, and after dispensing of the additive into container 1201. Cap 1202, so formed, may then be threaded against neck opening 1201-2 to seal container 1201.

In the following FIGS. 13A-13E, operation of liquid dispensing system 1200 (see FIG. 12) will be described in successive stages (or steps) representing an exemplary embodiment of a typical usage case. It is noted that an order of operations represented by FIGS. 13A-13E may be rearranged or modified or amended, as desired.

Figure 13A:
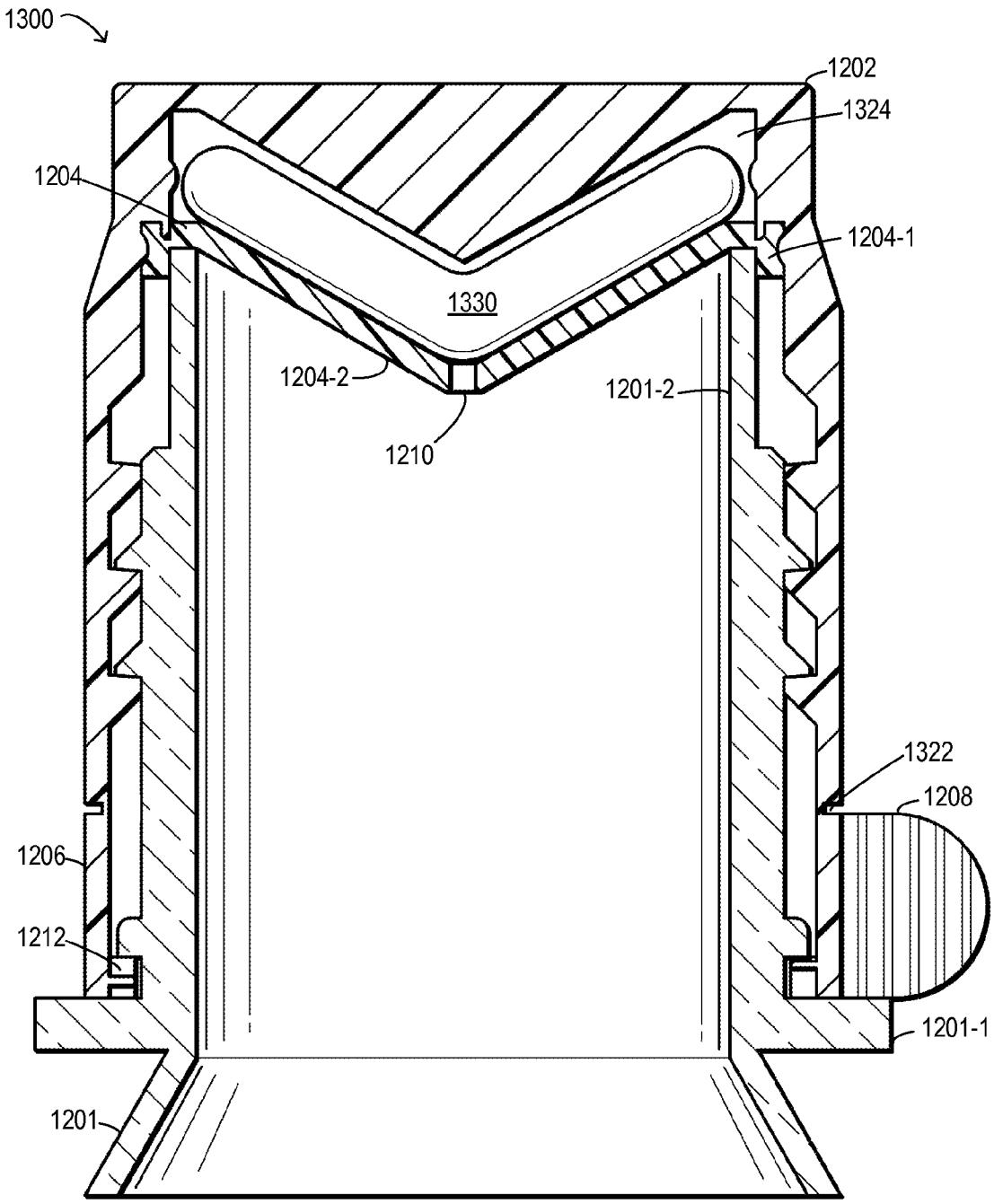
FIGS. 13A-13E are cross-sectional views of selected elements of an embodiment of a liquid dispensing system.

Referring now to FIG. 13A, a cross-sectional view 1300 of selected elements of an embodiment of a liquid dispensing system, corresponding to liquid dispensing system 1200 (see FIG. 12), is shown. In view 1300, various elements previously obscured in FIG. 12 are now visible in cross-section. Although a circular geometry for liquid dispensing system 1200 (see FIG. 12) is shown in the figures, it is noted that various other geometries may be implemented. Visible in FIG. 13A is container 1201, of which neck opening 1201-2 is enclosed and sealed by cap 1202, which also encloses additional elements, including retaining element 1204, additive bladder 1330, and additive chamber 1324. Additive bladder 1330 is assumed to contain an additive, as described previously herein. In view 1300, cap 1202 and container 1201 may be provided in a sealed 'unused' or 'new' configuration for use or purchase by a consumer, who may thusly be given an option to add the contents of additive bladder 1330 (i.e., the additive) to a base liquid (not shown in FIG. 13A) stored in container 1201, whenever the consumer so desires.

In FIG. 13A, cap 1202 is placed over neck opening 1201-2 to seal the contents of container 1201. Cap 1202 may accordingly mate with various portions of container 1201 in the configuration shown in view 1300. At one end, a lower surface of spacer/locking ring 1206 may circumferentially meet an upper surface of neck flange 1201-1, thereby preventing cap 1202 from moving further downward against neck flange 1201-1. In this position, detention elements 1212 may further prevent cap 1202 from undesired rotation and maintain a sealed condition of container 1201. Cap 1202 may further be in circumferential contact with retaining element 1204 at a top surface of neck opening 1201-2. As will be described in further detail, retaining element 1204 may be mechanically coupled for retention within cap 1202 during each of a number of usage steps. In view 1300, retaining element 1204 may be in circumferential contact with a top outer surface of neck opening 1201-2 at retaining ring 1204-1, which is an outer portion of retaining element 1204 that is specifically configured to mate with an interior surface of cap 1202 during retention and dispensing of the additive in additive bladder 1330. A top surface of neck opening 1201-2 may further be in circumferential contact with retaining element 1204 at a lower surface of retaining disc 1204-2, representing a central portion of retaining element 1204, which also may include one or more instances of dispensing hole 1210. This type of arrangement for affixing retaining element 1204 to an interior portion of cap 1202 may result in formation of additive chamber 1324, which may be a cavity suitable for holding and securely storing additive bladder 1330. It is noted that the configuration of liquid dispensing system 1200 shown in view 1300 provides multiple sealing surfaces to prevent undesired fluid leakage from within additive chamber 1324. In operation, cap 1202 may be released by turning to preferentially tear perforation 1322 to release spacer/locking ring 1206 or by manual removal of spacer/locking ring 1206, for example, by pulling removal tab 1208.

Figure 13B:
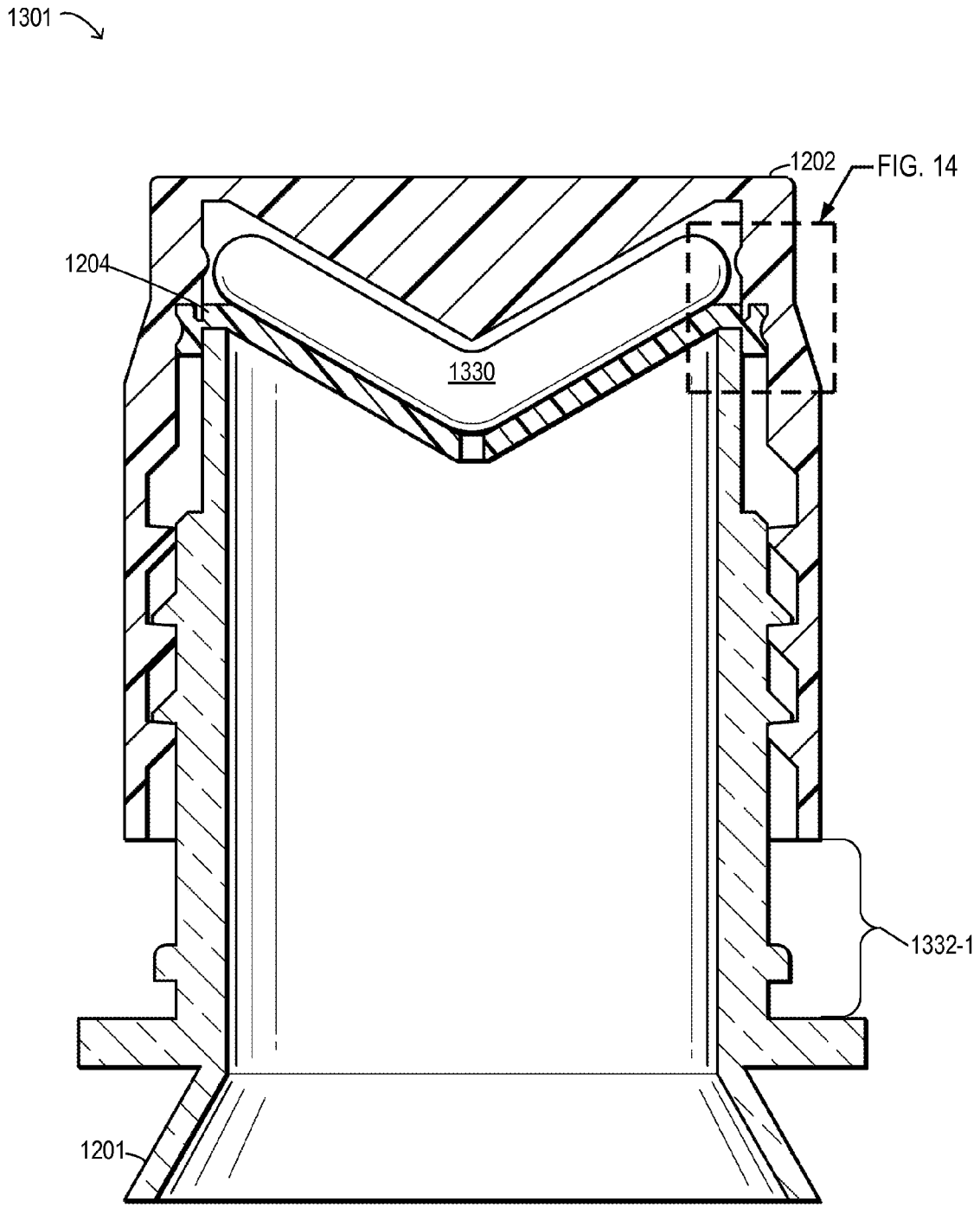

Continuing now to FIG. 13B, cross-sectional view 1301 depicts selected elements of liquid dispensing system 1200 (see FIG. 12). In view 1301, spacer/locking ring 1206 shown in view 1300 (see FIG. 13A) has been removed and cap 1202 is now free to rotate about container 1201. As shown in view 1301, vertical height 1332-1 represents a height that is substantially equivalent to a height of spacer/locking ring 1206, indicating that cap 1202 is in the same position relative to container 1201 as in view 1300 (see FIG. 13A). In view 1301, retaining element 1204 as well as additive bladder 1330 are in a substantially similar arrangement as shown in view 1300 (see FIG. 13A). In FIG. 13B, a region where neck opening 1201-2, retaining element 1204, and cap 1202 intersect that is described in further detail as FIG. 14 is shown with a corresponding reference to FIG. 14. It is noted that in view 1301, cap 1202 and retaining element 1204 still function to seal container 1201 and retain additive bladder 1330 intact.

Figure 13C:
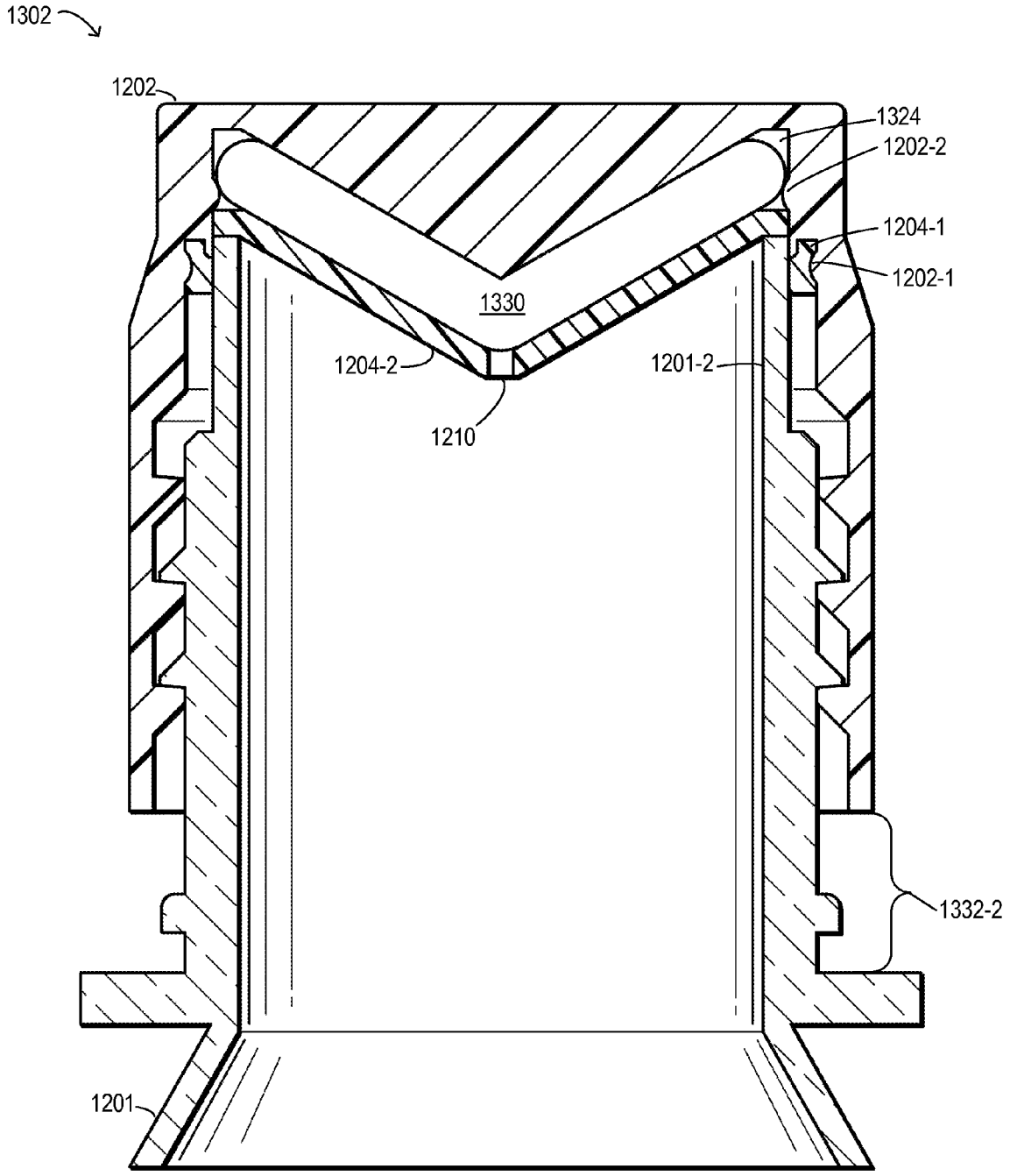

Advancing now to FIG. 13C, cross-sectional view 1302 depicts selected elements of liquid dispensing system 1200 (see FIG. 12). In view 1302, cap 1202 has now been screwed down against container 1201 such that vertical height 1332-2 is less than vertical height 1332-1 shown in view 1301 (see FIG. 13B). At the same time, retaining element 1204 has now been separated into two distinct portions (retaining disc 1204-2 and retaining ring 1204-1) at a preferential failure point (see also FIG. 14 for further details) through the action of a top surface of neck opening 1201-2 pressing against retaining element 1204. As a result of the novel and nonobvious design of cap 1202 and retaining element 1204, retaining ring 1204-1 is held in place between an outer circumferential surface of neck opening 1201-2 and cap 1202. Specifically, retaining ring 1204-1 is configured with an outer circumferential edge profile that mates with an inner surface of cap 1202 at cap fixture 1202-1, which serves to hold retaining ring 1204-1 securely in place after separation. Also shown in view 1302 is cap fixture 1202-2 which may allow retaining disc 1204-2 to be held in place after additive bladder 1330 has been emptied (see also FIG. 13D). As shown in view 1302, additive chamber 1324 has decreased in volume and pressure on additive bladder 1330 has increased, in advance of puncturing and dispensing of the additive through dispensing hole 1210. It is noted that in view 1302, cap 1202, retaining ring 1204-1, and retaining disc 1204-2 still function to seal container 1201 and prevent the contents of additive bladder 1330 from escaping other than via dispensing hole 1210.

Figure 13D:
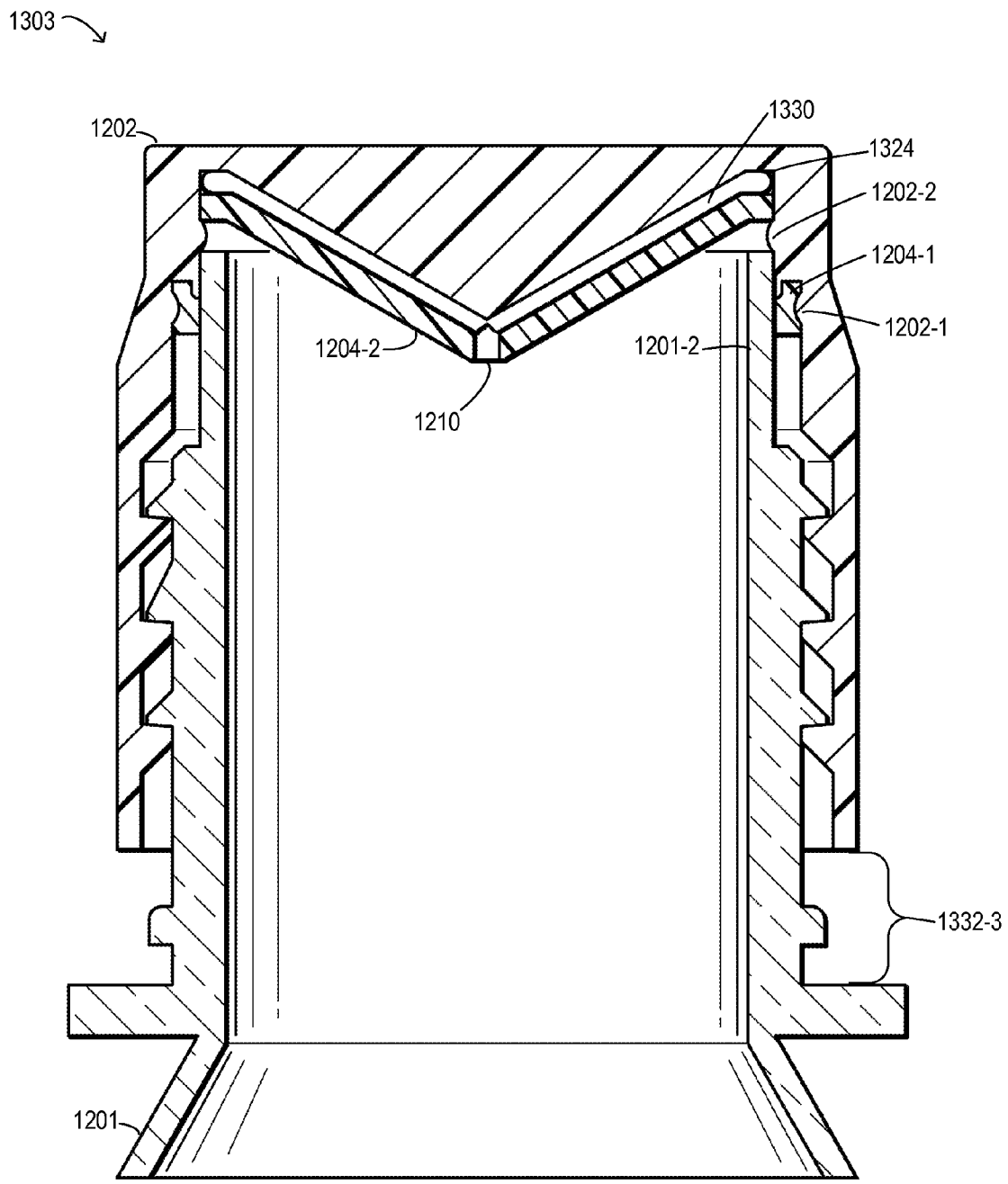

Turning now to FIG. 13D, cross-sectional view 1303 depicts selected elements of liquid dispensing system 1200 (see FIG. 12). In view 1303, cap 1202 has already been fully screwed down against container 1201 such that vertical height 1332-3 is less than vertical height 1332-2 shown in view 1302 (see FIG. 13C) and retaining disc 1204-2 is held in place by cap fixture 1202-2 while additive bladder 1330 has been emptied of its contents through dispensing hole 1210. At the same time, additive chamber 1324 now has a minimal volume containing a substantially empty additive bladder 1330. As shown in view 1303, cap 1202 has been opened slightly from the fully screwed-down position to show retention of retaining disc 1204-2 within cap 1202, but is still in a sealed condition with respect to container 1201. In view 1303, retaining ring 1204-1 remains held in place between an outer circumferential surface of neck opening 1201-2 and cap fixture 1202-1.

Figure 13E:
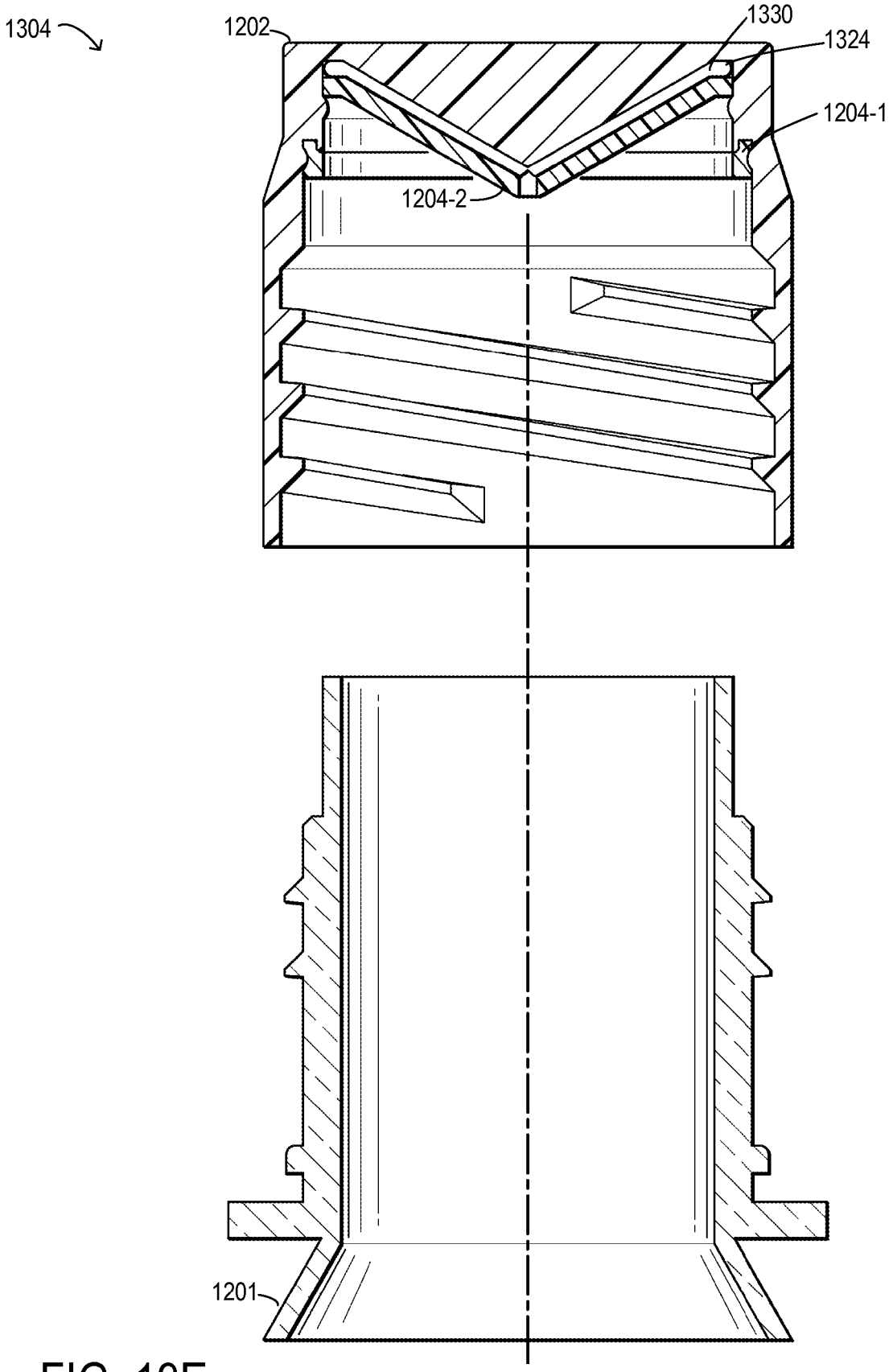

Referring now to FIG. 13E, cross-sectional view 1304 depicts selected elements of liquid dispensing system 1200 (see FIG. 12). In view 1304, cap 1202 now been removed to allow dispensing of base fluid from container 1201, which is now open. As in view 1303 (see FIG. 13D), view 1304 shows retaining ring 1204-1 remaining affixed to an inner portion of cap 1202, along with retaining disc 1204-2, which secures additive bladder 1330 within additive chamber 1324. It is noted that cap 1202 may be used to reseal and reopen container 1201, as desired.

Turning now to FIG. 14, a cross-sectional enlarged view of a portion of liquid dispensing system 1200 (see FIGS. 12 and 13B) is shown in detail. Specifically, a region where neck opening 1201-2, retaining element 1204, and cap 1202 intersect is shown in detail. In FIG. 14, cap 1202 is seen accepting (i.e., mating with) retaining element 1204 at cap fixture 1202-1 as well as at circumferential protrusion 1202-3, which both serve to secure retaining ring 1204-1. In addition, protrusion 1202-3 may also be configured to enable preferential separation of retaining ring 1204-1 from retaining disc 1204-2 at shear region 1204-3, where retaining element 1204 may exhibit a minimum material thickness, and accordingly, a minimum shear strength. The design of retaining element 1204 also shows how retaining ring 1204-1 is held in place after separation from retaining disc 1204-2, as described previously. Also visible in enlarged detail in FIG. 14 are additive chamber 1324, additive bladder 1330, as well as cap fixture 1202-1 and cap fixture 1202-2.

Figure 15:
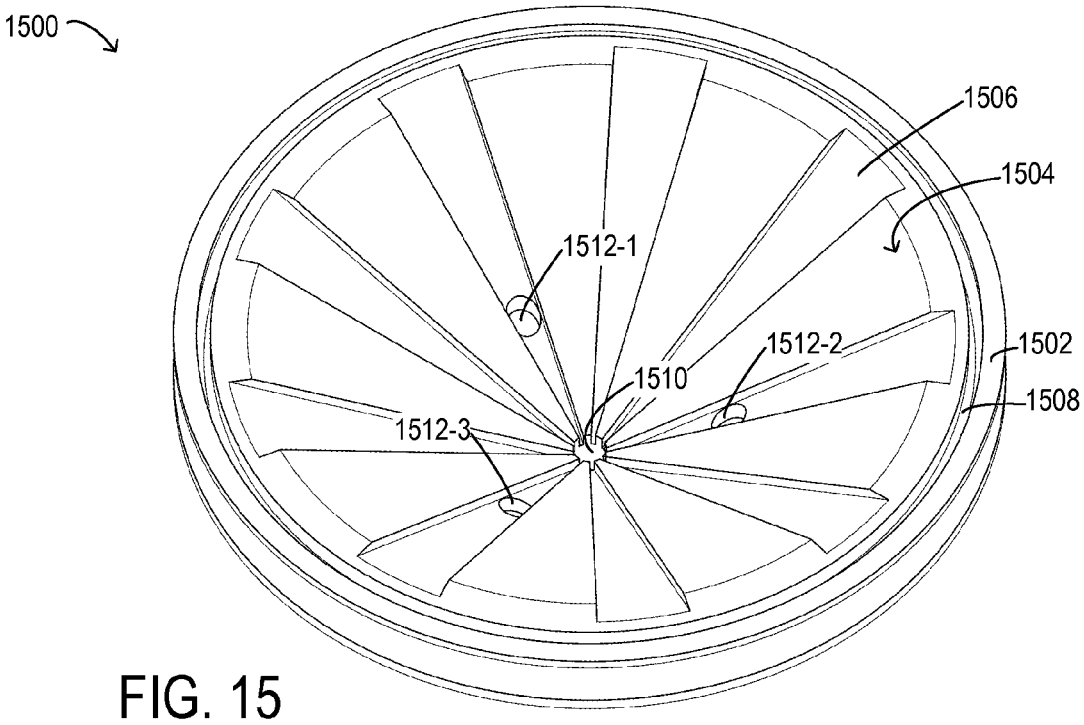
FIGS. 15 and 16 are external side views of selected elements of an embodiment of a liquid dispensing system.

Turning now to FIG. 15, an external side view of selected elements of an embodiment of retaining element 1500 is depicted. Retaining element 1500 may represent one embodiment of retaining element 1204, as discussed previously (see FIGS. 12-14). Retaining element 1500 is shown with retaining ring 1502 and circumferential groove 1508, forming a shear region with minimum material thickness, as described above with respect to FIG. 14. In FIG. 15, retaining element 1500 is shown having a number of novel and nonobvious features. Specifically, retaining element 1500 is formed with channels 1506 that are recessed with respect to top surface 1504 and which may promote unhindered flow of an additive fluid enclosed within an additive bladder, as described herein, since channels 1506 may remain open even when pressure is applied to the additive bladder. Also shown in FIG. 15 are dispensing holes 1512, which are respectively formed within three instances of channels 1506. In addition to centrally-located dispensing hole 1510, dispensing holes 1512-1, 1512-2, and 1512-3 are spaced at different locations and may further assist in promoting fluid flow when additive bladder 1330 is compressed within cap 1202 (see FIGS. 12-14) and may accelerate dispensing of the additive. It is noted that the features described above included in retaining element 1500 may also serve to reduce an amount of additive that would otherwise remain within the additive bladder and/or the additive chamber during normal usage of liquid dispensing system 1200, as described herein.

Figure 16:
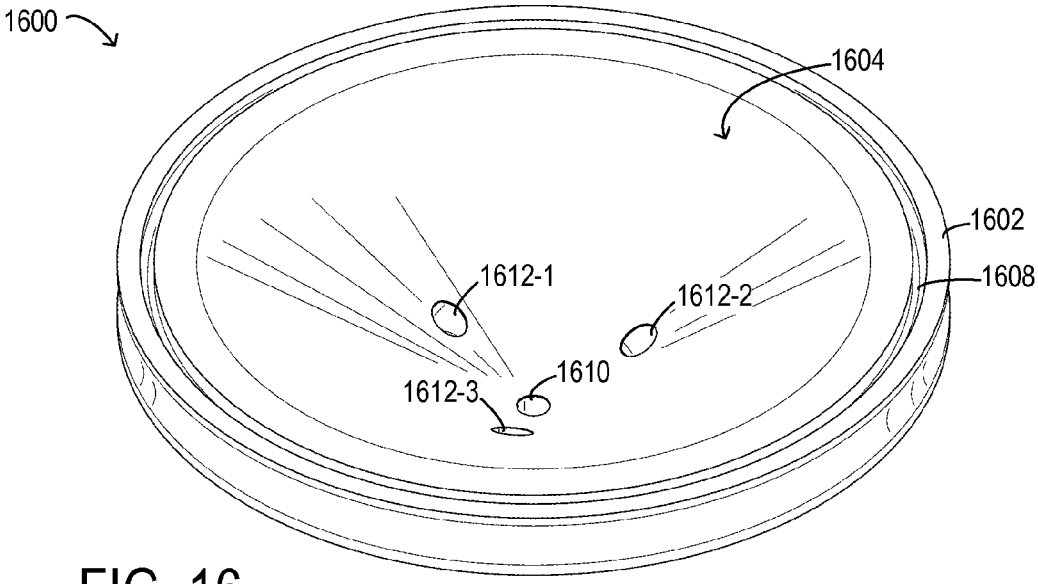

Turning now to FIG. 16, an external side view of selected elements of an embodiment of retaining element 1600 is depicted. Retaining element 1600 may represent one embodiment of retaining element 1204, as discussed previously (see FIGS. 12-14). Retaining element 1600 is shown with retaining ring 1602 and circumferential groove 1608, forming a shear region with minimum material thickness, as described above with respect to FIG. 14. In FIG. 16, retaining element 1600 is shown similar to retaining element 1500 (see FIG. 15), but with a smooth implementation for top surface 1604. Also shown in FIG. 16 are dispensing holes 1612, which are respectively formed at top surface 1604. In addition to centrally-located dispensing hole 1610, dispensing holes 1612-1, 1612-2, and 1612-3 are spaced at different locations and may further assist in promoting fluid flow when additive bladder 1330 is compressed within cap 1202 (see FIGS. 12-14) and may accelerate dispensing of the additive.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A contained system for dispensing additives comprising:
- a container for retaining a base liquid having a threaded neck opening;
- a retaining element in peripheral contact with the threaded neck opening and having an additive dispensing hole;
- an additive bladder in contact with the retaining element, including a portion of an additive enclosed by the additive bladder, wherein the retaining element seals an enclosed cavity containing the additive bladder with respect to an interior surface of the cap and a surface of the threaded neck opening;
- a convex element for pressing the additive bladder against the retaining element; and
- a cap for sealing the container enclosing the retaining element and the additive bladder including:
  - threads that rotatingly mate with the threaded neck opening;
  - a first circumferential cap fixture for mechanically securing the retaining element before dispensing of the additive; and
  - a second circumferential cap fixture for mechanically securing at least a portion of the retaining element after dispensing of the additive;

wherein the cap is configured to:
- upon rotation in a first angular direction, press the additive bladder against the retaining element in a closure direction, wherein the convex element presses against the additive bladder and the additive is released through the retaining element into the base liquid; and
- upon subsequent rotation in a second angular direction opposite the first angular direction, release from the threaded neck opening in an opening direction opposite the closure direction, wherein the retaining element and the additive bladder are retained in the cap.

2. A contained system for dispensing additives comprising:
- a container for retaining a base liquid having a threaded neck opening;
- a retaining element in peripheral contact with the threaded neck opening and having an additive dispensing hole;
- an additive bladder in contact with the retaining element, including a portion of an additive enclosed by the additive bladder, wherein the retaining element seals an enclosed cavity containing the additive bladder with respect to an interior surface of the cap and a surface of the threaded neck opening;
- a convex element for pressing the additive bladder against the retaining element;
- a cap for sealing the container enclosing the retaining element and the additive bladder including:
  - threads that rotatingly mate with the threaded neck opening;
  - a first circumferential cap fixture for mechanically securing the retaining element before dispensing of the additive; and
  - a second circumferential cap fixture for mechanically securing at least a portion of the retaining element after dispensing of the additive;

wherein the cap is configured to:

upon rotation in a first angular direction, press the additive bladder against the retaining element in a closure direction, wherein the convex element presses against the additive bladder and the additive is released through the retaining element into the base liquid; and a spacer ring for securing the cap attached to an outer edge of the cap, wherein a height of the spacer ring corresponds to at least a displacement of the cap sufficient to press substantially all of the additive from the additive bladder.

3. The system of claim 2, wherein the spacer ring is also attached to a locking ring, and wherein the spacer ring is configured to preferentially release from the cap upon rotation of the cap.

4. A contained system for dispensing additives comprising:

a container for retaining a base liquid having a threaded neck opening;

a retaining element in peripheral contact with the threaded neck opening and having an additive dispensing hole;

an additive bladder in contact with the retaining element, including a portion of an additive enclosed by the additive bladder, wherein the retaining element seals an enclosed cavity containing the additive bladder with respect to an interior surface of the cap and a surface of the threaded neck opening;

a convex element for pressing the additive bladder against the retaining element; and a cap for sealing the container enclosing the retaining element and the additive bladder including:

threads that rotatingly mate with the threaded neck opening;

a first circumferential cap fixture for mechanically securing the retaining element before dispensing of the additive; and a second circumferential cap fixture for mechanically securing at least a portion of the retaining element after dispensing of the additive;

wherein the cap is configured to:

upon rotation in a first angular direction, press the additive bladder against the retaining element in a closure direction, wherein the convex element presses against the additive bladder and the additive is released through the retaining element into the base liquid; and further wherein, upon rotation in the first angular direction, the retaining element separates into a retaining disc that presses against the additive bladder and a retaining ring that remains internally secured within the cap.

5. A contained system for dispensing additives comprising:

a container for retaining a base liquid having a threaded neck opening;

a retaining element in peripheral contact with the threaded neck opening and having an additive dispensing hole;

an additive bladder in contact with the retaining element, including a portion of an additive enclosed by the additive bladder; and a cap for sealing the container enclosing the retaining element and the additive bladder including:

threads that rotatingly mate with the threaded neck opening;

a first circumferential cap fixture for mechanically securing the retaining element before dispensing of the additive; and a second circumferential cap fixture for mechanically securing at least a portion of the retaining element after dispensing of the additive; and further wherein the additive bladder is made of a material that substantially isolates the additive from the environment, and wherein an upper surface of the retaining element includes recessed radial channels in which the additive is directed to the additive dispensing hole.

6. The system of claim 5, wherein the additive is at least one of: a liquid, a powder, a granulate, and a paste.

7. An additive dispensing system, comprising:

a cap for sealing a liquid container having threads that rotatingly mate with a threaded neck opening of the liquid container;

an additive bladder in contact with an inner surface of the cap and including a portion of an additive enclosed by the additive bladder; and a retaining element in contact with the additive bladder and having at least one additive dispensing hole, wherein the retaining element is held in place between the threads and the additive bladder, and wherein the retaining element seals an enclosed cavity containing the additive bladder with respect to an interior surface of the cap and a surface of the threaded neck opening, wherein, when the cap is screwed on to the liquid container, the cap is configured to press the additive bladder between the retaining element and an interior surface of the cap, wherein the additive is dispensed into the liquid container through the additive dispensing hole; and further wherein, when the cap is screwed on to the liquid container, the retaining element separates into a retaining disc that presses against the additive bladder and a retaining ring that remains internally secured within the cap.

8. The system of claim 7, wherein the retaining element includes at least two additive dispensing holes.

9. An additive dispensing system, comprising:

a cap for sealing a liquid container having threads that rotatingly mate with a threaded neck opening of the liquid container;

an additive bladder in contact with an inner surface of the cap and including a portion of an additive enclosed by the additive bladder; and a retaining element in contact with the additive bladder and having at least one additive dispensing hole, wherein the retaining element is held in place between the threads and the additive bladder, and wherein the retaining element seals an enclosed cavity containing the additive bladder with respect to an interior surface of the cap and a surface of the threaded neck opening, wherein, when the cap is screwed on to the liquid container, the cap is configured to press the additive bladder between the retaining element and an interior surface of the cap, wherein the additive is dispensed into the liquid container through the additive dispensing hole; and further wherein an upper surface of the retaining element includes recessed radial channels in which the additive is directed to the additive dispensing hole.

10. The system of claim 9, wherein the additive bladder is made of a material that substantially isolates the additive from the environment.

11. The system of claim 9, further comprising:

a convex element for pressing the additive bladder against the retaining element, wherein the interior surface of the cap is a surface of the convex element.

12. The system of claim 9, wherein the additive is at least one of: a liquid, a powder, a granulate, and a paste.

* * * * *